United States Patent [19]

Paglia

[11] 4,085,297

[45] Apr. 18, 1978

[54] SPRING FORCE BIASING MEANS FOR ELECTROACOUSTICAL TRANSDUCER COMPONENTS

[75] Inventor: Richard Paglia, Carlisle, Mass.

[73] Assignee: Polaroid Corporation, Cambridge, Mass.

[21] Appl. No.: 806,056

[22] Filed: Jun. 13, 1977

[51] Int. Cl.[2] ..... H04R 19/00

[52] U.S. Cl. ..... 179/111 R

[58] Field of Search ..... 179/111 R, 111 E

*Primary Examiner*—George G. Stellar

*Attorney, Agent, or Firm*—John J. Kelleher

[57] ABSTRACT

An electroacoustical transducer assembly of the type including a housing having a cylindrical side portion and a flanged end, a diaphragm having an insulative layer and an electrically conductive layer and having the periphery of said diaphragm in a fixed position with respect to said flanged end of said housing, a backplate having an electrically conductive surface and having said conductive surface in contact with said insulative layer of said diaphragm, is provided with a leaf spring having its end in cooperative interlocking engagement with said cylindrical side portion of said housing and having its intermediate portion resiliently pressing on said backplate.

22 Claims, 7 Drawing Figures

FIG. 3
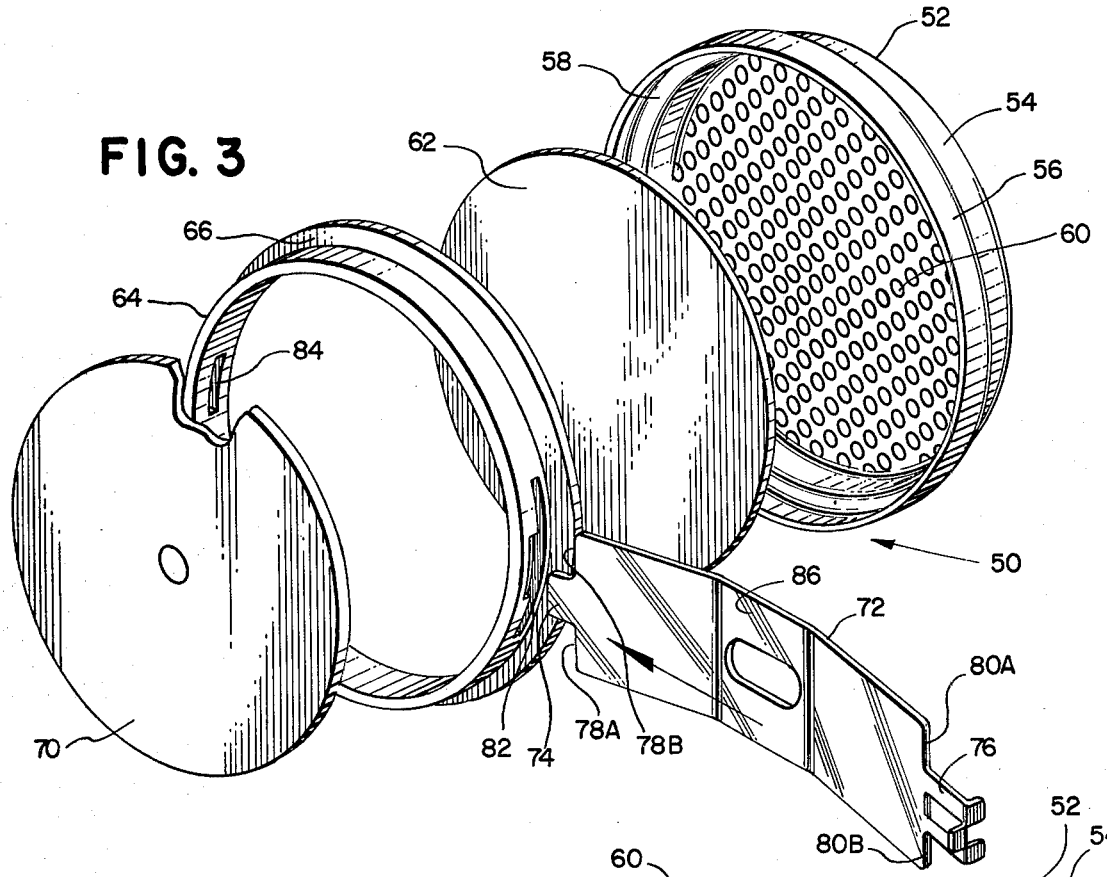
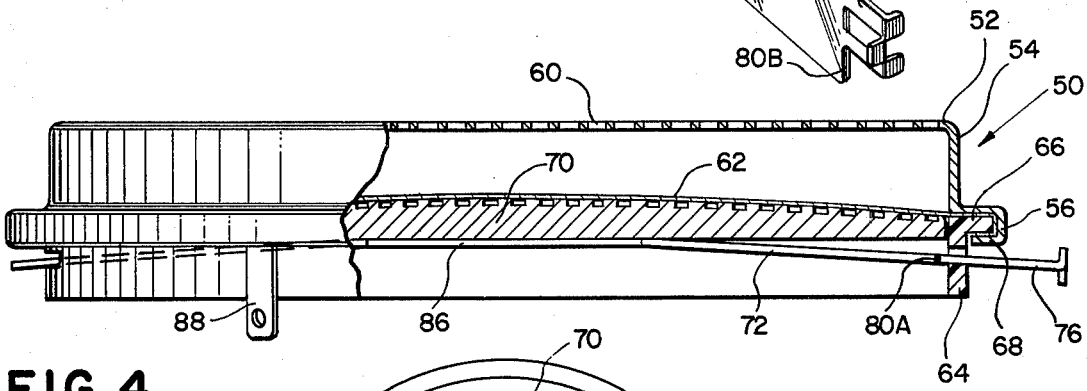
FIG. 4
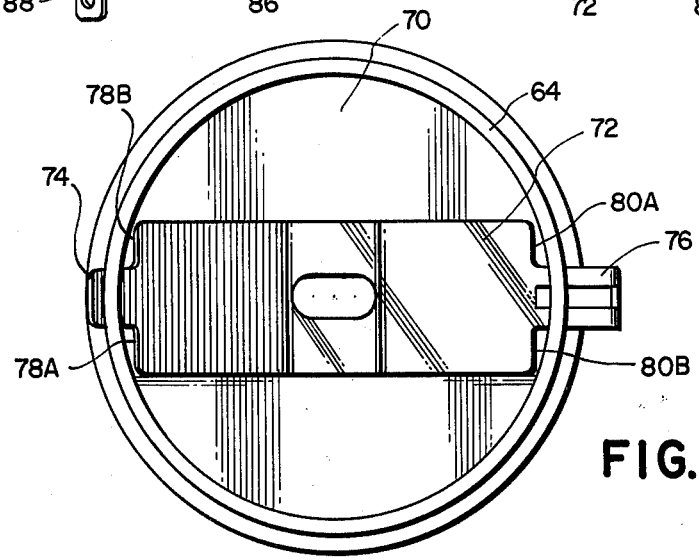
FIG. 5

SPRING FORCE BIASING MEANS FOR ELECTROACOUSTICAL TRANSDUCER COMPONENTS

BACKGROUND OF THE INVENTION

1. Field of the Invention

The present invention relates generally to capacitance type electroacoustical transducers and particularly to spring force biasing means for urging one member of such a device into engagement with another member of said device.

2. Description of the Prior Art

Capacitance type electroacoustical transducers are well known in the prior art. In such transducers, a diaphragm having an insulative layer and an electrically conductive layer has its insulative layer in contact with a grooved, irregular, electrically conductive surface of a substantially inflexible, plate-like member or backplate. The periphery of the diaphragm is maintained in a fixed position with respect to the transducer housing. A spring force urges said backplate into tensioning engagement with said diaphragm.

The insulative and electrically conductive layers of the diaphragm and the conductive surface of said backplate form a capacitor such that when a dc voltage is applied across the electrodes of said capacitor, irregularities on the grooved surface of the backplate set up localized concentrated electric fields in said insulative layer. When an ac signal is superimposed on said dc bias, the insulative layer is stressed such that oscillatory formations develop causing an acoustical wavefront to be propagated from the diaphragm. A received acoustical wavefront impinging on the insulative layer produces a variable voltage across the capacitor electrodes.

An extremely important design consideration for the above-described type of transducer is obtaining the correct diaphragm tension. Diaphragm tensioning greatly influences transducer acoustical output magnitude and direction, reception sensitivity and resonant frequency, for example. The prior art discloses several arrangements for obtaining the desired amount of diaphragm tensioning.

In one arrangement, illustrated in U.S. Pat. No. 3,814,864 issued June 4, 1974 to Victoreen, transducer diaphragm tensioning is provided by an adjustable coil spring. One end of the coil spring presses on the transducer backplate and the other coil spring end rests on a movable, disc shaped, spring force adjusting plate. Such an arrangement utilizes a relatively costly coil spring however, and requires an end wall to support one coil spring end.

In another arrangement, illustrated in copending U.S. Pat. application Ser. No. 741,228, by Muggli, et al., filed 12 Nov. 1976, and assigned to the assignee of the present invention, a metallic, diaphragm tensioning spring has its circular base engaging the bottom wall of a transducer housing. A plurality of fingers, having curved ends, extend upward from said circular base, said ends resiliently pressing on the diaphragm engaging backplate to provide the appropriate amount of diaphragm tensioning. This arrangement requires an end wall for spring support as in Victoreen. Also, utilizing a diaphragm tensioning spring of this type requires a relatively large amount of spring material which has an unfavorable impact on transducer cost.

Additionally, spring arrangements of the types described above require a relatively large amount of valuable space and are not readily installed in a transducer unit. Supplying an electrical signal to a transducer backplate with such spring arrangements increases transducer complexity.

SUMMARY OF THE INVENTION

In accordance with the present invention, an elongated resilient member is provided for urging the conductive surface of a plate-like member into tensioning engagement with the insulative layer of an electroacoustical transducer diaphragm having both insulative and conductive layers. Means are provided for maintaining a generally annular region of said conductive surface of said diaphragm in a fixed position with respect to a transducer housing. Ends of the elongated resilient member are in cooperative, interlocking engagement with sidewalls of said transducer housing and an intermediate portion of said elongated resilient member presses against said plate-like member thereby tensioning said diaphragm.

With the present invention, a low cost, minimum size, easily fabricated and assembled transducer diaphragm tensioning means is provided that avoids the necessity of a transducer housing endwall. In addition, the elongated resilient member of the present invention can be readily utilized as a conductive path for an electrical signal to said transducer plate-like member.

BRIEF DESCRIPTION OF THE DRAWINGS

FIG. 3 is an exploded view of an electroacoustical transducer assembly incorporating backplate spring force biasing means in accordance with the teachings of the present invention.

FIG. 4 is an elevational view, partially in section, of an assembled electroacoustical transducer of the type depicted in FIG. 3.

FIG. 5 is a bottom view of the electrocoustical transducer depicted in FIG. 4.

DETAILED DESCRIPTION OF THE PRIOR ART

Figure 1:
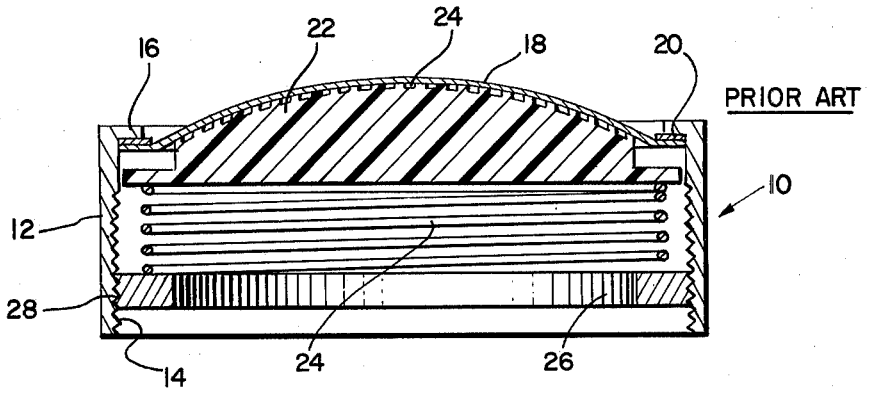
FIG. 1 is a sectional view, in elevation, of a capacitance type electroacoustical transducer incorporating coil-spring, force biasing means constructed in accordance with the teachings of the prior art.

Referring now to the drawings, and specifically to FIG. 1, which is a sectional view, in elevation, of capacitance type electroacoustical assembly 10 incorporating coil-spring, force biasing means constructed in accordance with the teachings of the prior art. The assembly includes cylindrical housing 12, of circular cross section, having threads 14 on an internal wall, and having an inward extending lip 16 at one end thereof. Diaphragm 18 formed of electrically nonconductive material, having an electrically conductive surface (not shown) on its external side has its periphery maintained in a fixed position with respect to the inner portion of said diaphragm by ring 20 to which said diaphragm is attached. Ring 20, in turn, engages an inner surface of housing lip 16. Backplate 22, having grooved electrically conductive surface 24, has said surface 24 in contact with the interior nonconductive surface of diaphragm 18. A tensioning force is applied to diaphragm 18 through backplate 22 by coil spring 24. Coil spring 24 has one end pressing on backplate 24 and the opposite end resting on adjustable plate 26, said plate having threaded portion 28 that cooperatively engages threads 14 of housing 12. The amount of tensioning force on diaphragm 18 can be changed by changing the position of plate 26 with respect to housing 12.

Plate 26, whether adjustable or not, is essential in order to support one end of spring 24. An electrical connection to electrically conductive surface 24 of backplate 22 must be through plate 26 and spring 24 or by means of a direct connection to a surface of backplate 22 through an opening (not shown) in housing 12 or in plate 26.

Figure 2:
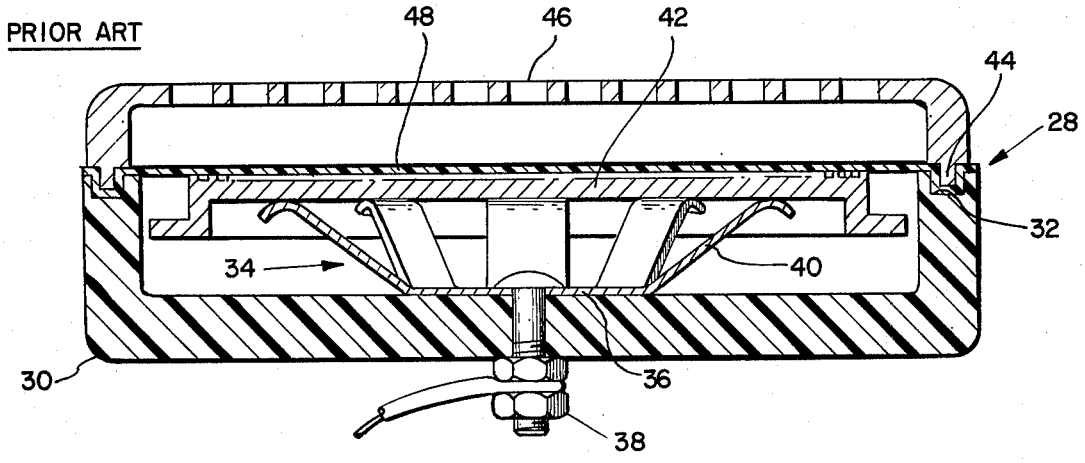
FIG. 2 is a sectional view, in elevation, of an electroacoustical transducer incorporating prior art backplate spring force biasing means, having a plurality of upward extending resilient fingers.

FIG. 2 depicts a sectional view, in elevation, of another capacitance type electroacoustical transducer assembly 28, that is also constructed in accordance with the teachings of the prior art. Transducer assembly 28 includes cylindrical housing 30, having cylindrical groove 32 at one end of the side portion of said housing 30. Spring 34 has its base portion 36 attached to the bottom of housing 30 by bolt means 38, said spring 34 having a plurality of upward extending curve ended fingers 40. The curved ends of fingers 40 engage a conductive surface of backplate 42, said backplate 42 having a grooved, electrically conductive upper surface. Tongue-like ring 44 extending from cylindrical cover 46 is inserted in groove 32 of housing 30 such that the periphery of diaphragm 48 is captured in said groove 32 and is uniformly stretched by such insertion. Diaphragm 48 is constructed of insulative material and has an electrically conductive upper surface. The lower, nonconductive surface of diaphragm 48 is in contact with the grooved, electrically conductive upper surface of backplate 42. The electrically conductive upper surface of membrane 48 is spaced from the screened end portion of cover 46. In addition to the above-described tensioning forces provided by housing 30 and cover 46, diaphragm 48 is also tensioned by fingers 40 of spring 34 pressing backplate 42 into engagement with said diaphragm 48. In transducer assembly 28, the endwall of housing 30 is necessary to support an end of spring 34 as was plate 26 in FIG. 1 to support an end of coil spring 24. The design of spring 34 is such that it also requires a relatively large amount of valuable space. An electrical connection to backplate 34 can be made through bolt means 38 and spring 34 without requiring an additional opening through housing 30, however.

DESCRIPTION OF THE PREFERRED EMBODIMENTS

Turning now to FIGS. 3 and 4, exploded and elevational views of capacitance type electroacoustical transducer assembly 50, incorporating a preferred embodiment of the present invention, are depicted. Transducer assembly 50 includes cylindrical cover 52 of circular cross section, having two cylindrical portions 54 and 56 of different diameters. Shoulder 58 of cover 52, lying in a plane that is parallel to screened end 60, separates small diameter portion 54 from said large diameter portion 56.

Diaphragm 62, constructed of relatively thin dielectric material, having electrically conductive vibratile and electrically nonconductive surfaces, is pressed into the open end of cover 52 to the point where an annular region of said diaphragm 62 uniformly rests on shoulder 58 of said cover 52. Diaphragm 62 has its electrically conductive vibratile surface adjacent the screened end of cover 52. Diaphragm 62 is of larger diameter than large diameter portion 56 of cover 52 and therefore its periphery folds backward as it is pressed into the open end of cover 52.

Inner ring 64, which is the main support housing of transducer 50, is of cylindrical shape, is of circular cross section, and has flange 66 extending laterally outward from one end thereof. The cylindrical shape forms the housing sidewall portion referred to herein. The flanged end 66 of inner ring 64 is inserted into the open end of cover 52 to the point where said flanged end 66 uniformly presses on the nonconductive surface of diaphragm 62. The periphery of diaphragm 62 and flanged end 66 of inner ring 64 are placed in a fixed position with respect to cover 52 by bending outer end 68 (FIG. 4) of large diameter portion 56 and the periphery of diaphragm 62 over said flange 66 such that cover 52 and diaphragm 62 are crimped to inner ring 64.

Backplate 70, a substantially inflexible, relatively high inertia plate-like member, is of circular cross section, has a plane surface on one side and has a grooved and curved surface on the opposite side. All of the external surfaces of backplate 70 are electrically conductive and are in an electrically conductive relationship with one another. Backplate 70 is of convex shape in that its center is of greater thickness than its periphery.

Leaf spring 77 has been formed such that it contains three contiguous plane surfaces. Said spring 72 is an elongated resilient member, has tongue-like portions 74 and 76 at the ends thereof, and has shoulder portions 78*a*, 78*b* and 80*a*, 80*b* extending laterally from said tongue-like ends, respectively. Additionally, tongue-like end 76 is in the form of an electrical lug to facilitate connection to an external electrical conductor.

Backplate 70 is inserted through the nonflanged end of inner ring 64 and has its grooved surface in contact with the nonconductive surface of diaphragm 62. Leaf spring 72 is inserted through T-shaped opening 82 in inner ring 64 such that tongue-like end 74 enters and cooperatively engages opening 84 in inner ring 64. When tongue-like end 74 fully engages said opening 84, tongue-like end 76 of leaf spring 72 cooperatively engages opening 82 that is also in said inner ring 64. Openings 82 and 84 in inner ring 64 pass through the circular sidewall portion of inner ring 64 and are diametrically shaped from one another. The intermediate portion 86 of leaf spring 72 presses on backplate 70, forcing said backplate into engagement with the nonconductive surface of diaphragm 62 which causes said diaphragm to become correctly tensioned for proper transducer operation; ends 74 and 76 of leaf spring 72 being reacted against the sides of openings 84 and 82, respectively.

Both openings, 82 and 84, pass completely through the sidewall portion of inner ring 64. Opening 84 is of rectangular cross section and is slightly larger than the rectangular cross section of leaf spring tongue-like end 74. Opening 82 is of T-shaped cross section with the horizontal bar portion of the "T" shape being slightly larger than the maximum cross section of leaf spring 72; the vertical bar portion of the "T" shape being slightly larger than the widest portion of the rectangular cross section of leaf spring tongue-like end 76. When tongue-like ends 74 and 76 of leaf spring 72 fully engage openings 84 and 82 of inner ring 64, respectively, leaf spring 72 becomes interlocked in position in that only a limited degree of movement is permissable. When full leaf spring engagement occurs, tongue-like end 76 of leaf spring 72 snaps down into the vertical bar portion of T-shaped opening 82. In this position, shoulders 80*a* and 80*b* at one end of leaf spring 72 and shoulders 78*a* and 78*b* at the opposite end of leaf spring 72 are engageable with an inner wall of a sidewall portion of inner ring 64 to form an interlocking relationship.

FIG. 5 shows leaf spring 72 in the just described interlocked position. In FIG. 5, which is a bottom view of transducer assembly 50 depicted in FIG. 4, the ends of leaf spring 72 are shown slightly spaced from the inner wall of the sidewall portion of inner ring 64. As previously noted, leaf spring 72 is permitted a limited degree of movement within inner ring 64. To eliminate this limited amount of above-described leaf spring movement, the length of leaf spring 72 between its shouldered ends would be slightly lengthened to the point where the shouldered ends of said leaf spring 72 are in contact with an inner wall of the sidewall portion of inner ring 64. However, a leaf spring of this length would be more difficult to assemble than one permitting a limited degree of leaf spring movement.

Leaf spring 72 is removed from transducer assembly 50 by depressing said leaf spring toward backplate 70 near T-shaped opening 82 (FIG. 4) until shoulder portions 80*a* and 80*b* are in registration with the horizontal bar portion of said T-shaped opening 82. Once said registration with opening 82 is achieved, leaf spring 72 is withdrawn through said opening 82.

In operation, it is necessary to supply an electrical signal to the conductive surface of dielectric membrane 62 and to the grooved electrically conductive surface of backplate 70. With reference to FIG. 4, it can be seen that metallic lug 88 is in electrical contact with metallic cover 52 which, in turn, is in electrical contact with the electrically conductive surface of diaphragm 62 in the region where said cover 52 is crimped to said diaphragm 62 and flanged portion 66 of inner ring 64. Therefore, an electrical signal applied to lug 88 will also be applied to the conductive surface of diaphragm 62. Intermediate portion 86 of leaf spring 72 is in electrical contact with the grooved surface of backplate 70 through an intermediate surface of said backplate 70. Applying an electrical signal to tongue-like end 76 of leaf spring 72 will apply an electrical signal to the grooved, electrically conductive surface of backplate 70. Tongue-like end 76 is readily connected to an external electrical conductor in that said end 76 is in the form of an electrical lug and extends a substantial distance beyond the sidewall portion of inner ring 64 to avoid physical interference with said sidewall.

Figure 6:
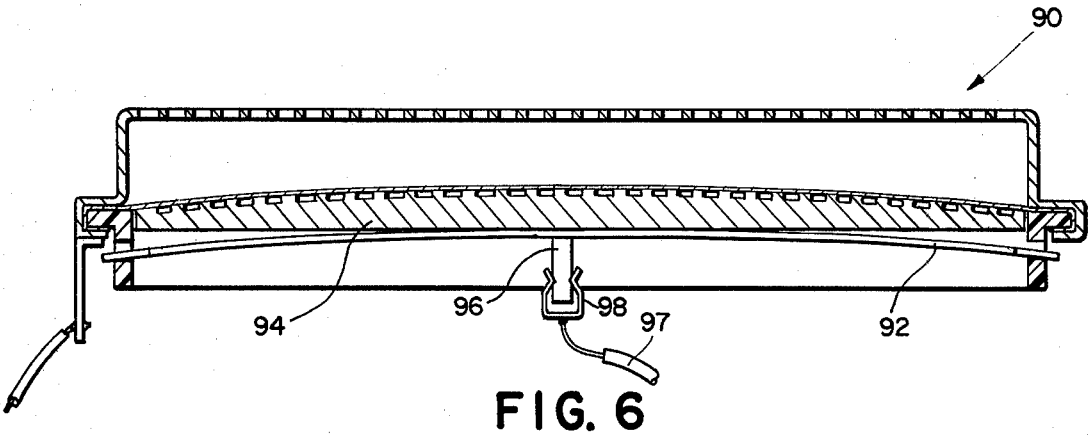
FIG. 6 is a sectional view, in elevation, of an electroacoustical transducer of the type depicted in FIGS. 3 and 4 incorporating alternate means for supplying an electrical signal to the backplate of said transducer.

An alternate arrangement for supplying an electrical signal to a capacitance type electroacoustical transducer 90 is shown in FIG. 6. Except for leaf spring 92 and backplate 94, the construction of transducer assembly 90 in FIG. 6 is identical with that of transducer assembly 50 in, for example, FIG. 4. In FIG. 6, backplate 94 is identical in construction with backplate 70 in FIG. 4 except that pin 96 extends outwardly from the plane surface of said backplate 94. The surface of pin 96 is electrically conductive and is in electrical contact with the grooved, curved surface of backplate 94, through an intermediate backplate 94 surface. An electrical signal supplied to pin 96 from external electrical conductor 97 through electrical lug 98, having resilient fingers in pressing contact with said pin 96, will supply an electrical signal to the grooved, electrically conductive surface of said backplate 94. With such an arrangement, there is no need for a leaf spring having a lugged end such as leaf spring 72 in transducer assembly 50, and therefore tongue-like ends 100 and 102 of leaf spring 92 have the same physical shape. In transducer assembly 90, however, the profile of leaf spring 92 is that of a continuous curve, and not that of a plurality of contiguous plane surfaces such as leaf spring 72 in FIG. 4.

Figure 7:
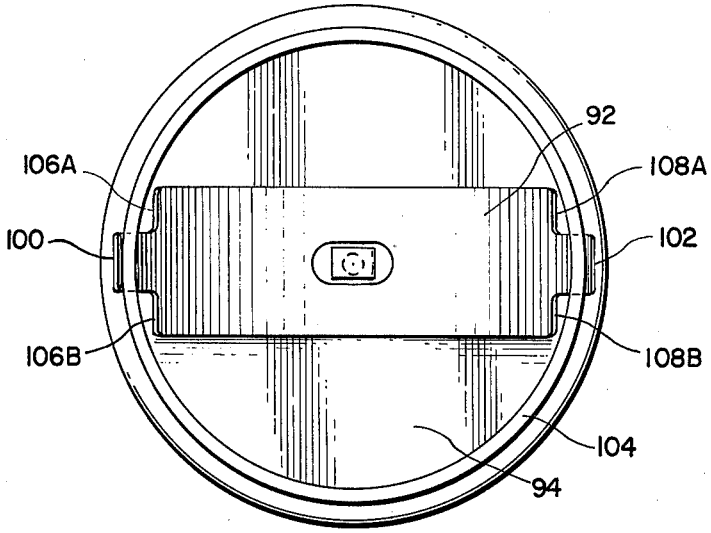
FIG. 7 is a bottom view of the electroacoustical transducer depicted in FIG. 6.

In FIG. 7, which is a bottom view of transducer assembly 90 depicted in FIG. 6, leaf spring 92 is shown in its installed, fully interlocked position. The physical position of leaf spring 92 and the means for locking same to inner ring 104 are identical to that shown for leaf spring 72 and inner ring 64 in, for example, FIG. 4. Shouldered ends 106*a*, 106*b* at one end of leaf spring 92 and shouldered ends 108*a*, 108*b* at the opposite end of leaf spring 92 are engageable with an inner wall of inner ring 104, once said leaf spring 92 is fully assembled in said inner ring 104. Leaf spring 92 is removed from transducer assembly 90 in the same manner that leaf spring 72 is removed from transducer assembly 50. The end of leaf spring 92 nearest the T-shaped opening through inner ring 104 is depressed toward backplate 94 until shoulders 108*a* and 108*b* are in registration with the horizontal bar portion of said T-shaped opening. When registration is achieved, leaf spring 92 is withdrawn through said T-shaped inner ring 104 sidewall opening.

GENERAL CONSIDERATIONS

The preferred embodiment of the present invention can be utilized in a capacitance type electroacoustical transducer having its own polarizing voltage, sometimes referred to as an electret, or in a transducer wherein the polarizing voltage is externally supplied. Dielectric membrane tensioning is necessary in both such devices and the leaf spring arrangement described herein can be readily and advantageously utilized for such tensioning. Forming an extending leaf spring end into an electrical lug for connection to an external electrical conductor to supply a signal or bias voltage, or both, to the backplate member of an electroacoustical transducer, is an arrangement that is equally applicable to both of the above-mentioned types of capacitance type electroacoustical transducers.

The preferred embodiment of the present invention utilizes a metallic, electrically conductive cover and leaf spring. The inner ring is constructed of an insulative or relatively nonconducting material. It may be desirable to utilize a different combination of such materials for these three members and all such combinations are contemplated for use with the present invention.

The backplates or plate-like members utilized in the preferred embodiments described herein are of plastic construction and all of their external surfaces are electrically conductive to provide a conductive path from one such surface to another. However, an electrically conductive path through the backplate to the electrically conductive surface in contact with a nonconductive diaphragm surface or any other nonconductive material being utilized in place of such nonconductive surface, can be provided by utilizing a backplate body constructed of electrically conductive materials such as brass, copper, etc., rather than one made of plastic.

Unless otherwise provided, the term opening used herein means those openings that pass either partially or completely through the structure in which they are located.

The terms layer, surface, component and film as used herein refer to electrically conductive or electrically nonconductive membranous-like structures that may or may not be of uniform thickness.

In the preferred embodiment described herein, the diaphragm with its conductive and nonconductive layers has been indirectly described as being of unitary construction. It is within the scope of the present invention to construct an electroacoustical transducer such that each of the elements forming what has been referred to herein as a capacitor may be separately constructed prior to being assembled into the capacitor portion of the transducer. In such case, the diaphragm referred to in this paragraph would consist of physically separate conductive and nonconductive layers that would not be placed in contact with one another until the transducer is assembled.

The T-shaped opening in the sidewall portion of the housing that is described herein is one type of opening having a groove in a side thereof. The groove in such an opening is the vertical bar in a normally upright T.

When the end portions of the elongated resilient member or leaf spring are described herein as being cooperatively engaged with a transducer housing sidewall portion, such description includes inward extending sidewall portion projections or lips or any combination of openings and such projections that engage the end portions of said resilient member or leaf spring.

In the preferred embodiment of my invention, the transducer cover member is crimped to the dielectric membrane and to the inner ring or housing. While such an arrangement is the preferred one, the leaf spring force biasing means disclosed herein would be equally applicable to capacitance type electroacoustical transducers utilizing any number of other types of cover attaching means such as rivetting, adhesives, solder, etc. or the like.

It will be apparent to those skilled in the art from the foregoing description of my invention that various improvements and modifications can be made in it without departing from its true scope. The embodiments described herein are merely illustrative and should not be viewed as the only embodiments that might encompass my invention.

What is claimed is:

1. An improved electroacoustical transducer assembly of the type including,
- a housing,
  - said housing defining a sidewall portion,
- a vibratile, electrically conductive layer,
- means for maintaining a portion of an annular region of said layer in a fixed position with respect to said housing,
- an electrically nonconductive layer adjacent said electrically conductive layer,
- a substantially inflexible plate-like member having an electrically conductive surface, wherein the improvement comprises:
- an elongated resilient member having at least two end portions,
  - said end portions of said elongated resilient member cooperatively engaging said housing sidewall portion such that an intermediate portion of said elongated resilient member presses on said plate-like member causing said plate-like member to press on said electrically nonconductive layer thereby forcing said nonconductive layer into tensioning engagement with said electrically conductive layer.

2. The assembly defined in claim 1 wherein said elongated resilient member and said housing are cooperatively engaged in an interlocking relationship.

3. The assembly defined in claim 1 wherein said cooperative engagement between said housing sidewall portion and said end portions of said elongated resilient member comprises:
- said sidewall portion defines at least one opening having a minimum cross section that is no less than the maximum cross section of said elongated resilient member,
  - said minimum cross section opening having a groove in a side thereof; and
- said elongated resilient member includes at least one tongue-like end portion having a shoulder portion extending laterally therefrom,
  - said tongue-like end portion of said elongated resilient member cooperatively engages said groove in said minimum cross section opening,
    - its laterally extending shoulder portion being for engagement with an inner wall of said sidewall portion of said housing,
  - another end portion of said elongated resilient member engages said housing sidewall portion.

4. The assembly defined in claim 3 wherein said minimum cross section opening is of T-shaped cross section.

5. The assembly defined in claim 4 wherein the direction of said T-shaped cross section opening is orthogonal to an inner surface of said sidewall portion of said housing.

6. The assembly defined in claim 1 wherein an end of said elongated resilient member extends substantially beyond said sidewall portion of said housing,
- said extending end incorporating means for connecting to an external electrical conductor,
- an intermediate portion of said elongated resilient member making electrical connection with said electrically conductive surface of said plate-like member.

7. The assembly defined in claim 6 wherein said extending end of said elongated resilient member is an electrical lug.

8. The assembly defined in claim 1 wherein said means for maintaining a portion of an annular region of said electrically conductive layer in a fixed position with respect to said housing comprises:
- a cover including a side portion and a screened end,
  - said screened end of said cover being adjacent said vibratile, electrically conductive layer,
  - said side portion of said cover crimping said annular region of said electrically conductive layer to said housing.

9. An electroacoustical transducer assembly of the type including,
- a cylindrical housing having a sidewall portion and a flanged portion,
- a substantially inflexible backplate having an electrically conductive surface,
- a diaphragm formed of an electrcially nonconducting film having an electrically conductive surface,
- means for maintaining a portion of the periphery of said diaphragm in a fixed position with respect to said flanged portion of said housing, wherein the improvement comprises:
- a leaf spring having at least two end portions, said end portions of said leaf spring engaging said housing sidewall portion such that an intermediate portion of said leaf spring presses on said backplate causing said backplate to press on said electrically nonconducting film thereby tensioning said diaphragm.

10. The assembly defined in claim 9 wherein said leaf spring and said cylindrical housing are cooperatively engaged in an interlocking relationship.

11. The assembly defined in claim 10 wherein said cooperative and interlocking engagement between said housing sidewall portion and said end portions of said leaf spring comprises:

said sidewall portion defines at least one opening having a minimum cross section that is no less than the maximum cross section of said leaf spring, said minimum cross section opening having a groove in a side thereof; and said leaf spring includes at least one tongue-like end portion having a shoulder portion extending laterally therefrom, said tongue-like leaf spring end portion cooperatively engages said groove in said minimum cross section opening, its laterally extending shoulder portion being for engagement with an inner wall of said sidewall portion of said housing, another end portion of said leaf spring cooperatively engages said housing sidewall portion.

12. The assembly defined in claim 9 wherein said means for maintaining a portion of the periphery of said diaphragm in a fixed position with respect to said flanged end portion of said housing comprises:

a cylindrical cover including a screened end and a side portion, said screened end of said cover being adjacent said electrically conductive surface of said diaphragm, said side portion of said cylindrical cover crimping the periphery of said diaphragm to said flanged portion of said housing.

13. The assembly defined in claim 11, wherein said minimum cross section opening is of T-shaped cross section.

14. The assembly defined in claim 11 wherein an intermediate portion of said leaf spring includes a plane surface.

15. The assembly defined in claim 14 wherein said leaf spring includes a plurality of plane surfaces.

16. The assembly defined in claim 11 wherein said sidewall portion of said cylindrical housing is of circular cross section and defines two spaced apart openings, said openings being diametrically spaced from one another, the ends of said leaf spring cooperatively engaging said diametrically spaced apart openings.

17. The assembly defined in claim 11 wherein a portion of the length of said leaf spring is in the shape of a continuous curve.

18. The assembly defined in claim 11 wherein an end of said leaf spring extends substantially beyond said sidewall portion of said cylindrical housing, said extending end incorporating means for connecting to an external electrical conductor, an intermediate portion of said leaf spring making electrical connection with said electrically conductive surface of said backplate through at least one intermediate electrically conductive surface of said backplate.

19. The assembly defined in claim 18 wherein said extending end of said leaf spring is an electrical lug.

20. The assembly defined in claim 11 further comprising:

an electrically conductive pin extending from said backplate for connection to resiliently clamping electrical lug means, said pin making electrical connection with said electrically conductive backplate surface.

21. An improved electroacoustical transducer assembly comprising:

a substantially inflexible plate-like member having an electrically conductive major surface and another major surface;

a substantially thin vibratile electrically conductive component;

a substantially thin electrically nonconductive component; and means for tensioning said vibratile electrically conductive component over said electrically conductive major surface of said plate-like member with said electrically nonconductive component disposed intermediate said electrically conductive component and said conductive major surface of said plate-like member, said tensioning means including opposed wall portions located in the vicinity of peripheral portions of said assembly and projecting in the direction away from said electrically conductive component on the opposite side of said plate-like member from said electrically conductive component and a flexible member connected between said opposed wall portions in a manner imparting a bow to said flexible member exerting a resilient force against said other major surface of said plate-like member.

22. The assembly of claim 21 wherein said flexible member has a given length and thickness, a midsection of given width and one end including a tongue-like projection having a width less than said width of said flexible member's midsection and wherein one of said wall portions has a substantially T-shaped opening passing therethrough with the horizontal bar of said T-shaped opening disposed in generally parallel alignment with said plate-like member, the length of said horizontal bar of said T-shaped opening being greater than the maximum width of said flexible member and the width of said horizontal bar of said T-shaped opening being greater than said thickness of said flexible member to accommodate the slidable insertion of said flexible member through said horizontal bar of said T-shaped opening during the assemblage of said assembly, the vertical bar of said T-shaped opening extending from its said horizontal bar in the direction away from said plate-like member, said vertical bar of said T-shaped opening having a width less than said width of said midsection of said flexible member but greater than said width of said tongue-like projection such that, when the other end of said flexible member is in contact with the other of said wall portions and said flexible member flexed to provide said bow therein, said tongue-like projection of said flexible member is seated in said vertical bar of said T-shaped opening to facilitate the connection of said flexible member between said opposed wall portions.

* * * * *